US006131822A

United States Patent [19]

Farmer, Jr.

[11] Patent Number: 6,131,822

[45] Date of Patent: Oct. 17, 2000

[54] SPRINKLER HEAD PROTECTION DEVICE

[76] Inventor: Robert E. Farmer, Jr., 154 Cypress Cove, Jupiter, Fla. 33459

[21] Appl. No.: 09/461,898

[22] Filed: Dec. 15, 1999

[51] Int. Cl.[7] ..... B05B 1/28; A62C 25/00

[52] U.S. Cl. ..... 239/288; 239/209; 169/37; 169/51; 150/156; 383/71; 383/207

[58] Field of Search ..... 239/104, 208, 239/209, 288, 288.3; 169/16, 37, 51, 54; 150/154, 155, 156; 383/71, 72, 207

[56] References Cited

U.S. PATENT DOCUMENTS

| | | | |
|---|---|---|---|
| 1,949,121 | 2/1934 | Herder | 383/207 X |
| 4,921,028 | 5/1990 | Schwartz | 150/155 |
| 4,964,470 | 10/1990 | Gaulin | 169/54 X |
| 4,975,688 | 12/1990 | Gonzales | 383/71 X |
| 5,649,598 | 7/1997 | MacDonald, III | 169/37 X |
| 5,743,337 | 4/1998 | MacDonald, III | 169/51 X |
| 5,918,807 | 7/1999 | Doss | 239/288 X |

*Primary Examiner*—Andres Kashnikow
*Assistant Examiner*—Steven J. Ganey
*Attorney, Agent, or Firm*—McHale & Slavin

[57] ABSTRACT

A protection device designed to protect pendent-type sprinkler heads includes a shroud member that removably encloses a selected sprinkler head and a positioning member that selectively maintains the shroud member in a preferred orientation with respect to the sprinkler head. An included tearing member facilitates removal of the shroud member; the tearing member is a flexible, inelastic member that, when pulled correctly, will tear the shroud member along a predetermined path. The shroud member, itself, is characterized by lines of perforation that cooperate with the tearing member to ease shroud member removal.

21 Claims, 3 Drawing Sheets

SPRINKLER HEAD PROTECTION DEVICE

FIELD OF THE INVENTION

This invention is directed to fire-prevention sprinkler systems and, in particular, to a removable protection device for shielding a pendent-type sprinkler head from damage while the surrounding ceiling or immediately-surrounding area is being coated with plaster, paint, or the like.

BACKGROUND OF THE INVENTION

Fire-prevention sprinkler systems are mandatory in most commercial settings to provide automated water release in an effort to stop or inhibit fire damage. These systems typically employ a network of ceiling-mounted piping that delivers water, or other fire extinguishing liquids, from a supply source to a series of strategically-placed corinkler heads. In many cases, the sprinkler heads include heat sensitive components that automatically trigger a release of water when a threshold temperature is reached. With this arrangement, large areas may be protected without human intervention and with relatively high efficiency.

Because fire can occur in a variety of locations within a given building, fire-preventer sprinkler systems typically place sprinkler heads at uniformly-spaced intervals across a given ceiling. As a result, most fire-prevention sprinkler systems utilize large amounts of piping, with the piping being finished to match the background ceiling or hidden behind decorative panels. To this end, many fire-prevention sprinkler systems are installed before the building ceilings are complete, thereby allowing the network of piping to be camouflaged during the ceiling finishing process. By taking this approach, fire-prevention sprinkler systems can be made to blend inconspicuously into an associated background ceiling.

Fire-prevention sprinkler system piping and connector fittings are typically robust and not affected by the application of paint or other types of finishing products, such as blown particle "popcorn" coatings or sprayed insulation. However, the sprinkler heads themselves incorporate delicate components that may be damaged or fouled through careless application of ceiling treatment materials.

Unfortunately, sprinkler head damage may go unnoticed until the sprinkler system is activated, typically in an emergency situation, and one or more of the sprinkler heads operates ineffectively. In buildings that are hard for firefighters to reach, sprinkler head failure can be disastrous, leading to extreme building damage and even loss of life. Accordingly, several approaches have been contemplated to maintain the functionality of sprinkler heads installed before ceiling finishing materials have been applied.

In some instances, ceiling finishers prevent sprinkler head damage by taking extreme care when decorating the area around each sprinkler head. With the correct tools, and enough time, ceiling finishes may be painstakingly applied in a manner that avoids damaging the sprinkler heads. However, such a deliberate process is not always possible or cost effective.

In other cases, adhesive tape is wrapped around the individual sprinkler heads to provide a protective barrier that prevents intrusion of unwanted material during the ceiling finishing process. Unfortunately, tapes that are substantial enough to provide a useful barrier can cause problems during removal and may even hinder sprinkler performance once removed. More particularly, many of the duct and masking tapes used to form barriers are difficult to remove.

When these tapes are used, sprinkler heads are often damaged through rough treatment as the tape is removed, resulting in unreliable sprinkler heads that may activate prematurely or not at all. Even tape barriers that have been removed gently can create troubles by leaving a tacky adhesive that collects dirt and dust over time, leading to fouled nozzles and degradation of sprinkler performance.

Still other ceiling finishers choose to surround individual sprinkler heads with small, non-permeable plastic bags, such as shown in U.S. Pat. No. 4,975,688. Although these bags provide barriers, they are not appropriate in many situations. For example, bags used to surround ceiling-mounted sprinkler heads may collect enough heat to inadvertently trigger the fire-sensing components, especially in warmer climates and where air conditioning systems have not yet been activated. Plastic bag use is troublesome in cooler climates, as well. Many plastic bags used are clear, making them difficult to see in the shadows that characterize many finished ceilings. As a result, it is possible to inadvertently leave one or more bags in place after the ceiling finishing process is complete. The non-permeable nature of these bags makes such an oversight costly during a fire. Water released by a surrounded sprinkler head will not be dispersed until the bag melts away, bursts or is somehow removed. In any event, unremoved plastic bags hinder the fire extinguishing effectiveness of the sprinkler heads which they surround. Using plastic bags to protect fire-prevention sprinkler heads solves one type of problem only to create others.

Other ceiling finishers hare even covered sprinkler heads with paper bags, to avoid the concerns associated with plastic coverings. Unfortunately, while paper bags may provide a sufficient barriers and advantageously avoid issues associated with plastic bag, known paper bags have other liabilities. For example, paper bags can absorb finishing materials, becoming rigid and difficult to remove once the ceiling finishing process has been completed. In such instances, although the bag may eventually be worked free, rough handling may be required to wrench the bag loose and the underlying sprinkler head may become damaged.

Thus, what is needed is a sprinkler head protection device that includes advantages of the known devices, while addressing the shortcomings they exhibit. The device should protect a selected pendent-type sprinkler head from damage while the surrounding ceiling is being treated. The device should be easy to install and remove, without the need for tools and without damaging the protected sprinkler head. The device should also inexpensive and disposable if desired. The device should include provisions to facilitate easy removal so as to prevent rough handling during the removal process, thereby protecting the underlying sprinkler head, even if the device has been coated with finishing material. The device should not interfere with sprinkler head functionality after removal. The device should also be usable in warm climates and in buildings without air conditioning.

SUMMARY OF THE INVENTION

The instant invention is a protection device designed to protect pendent-type sprinkler heads, especially during finishing and decorating of surrounding areas. The device is especially suited for use with ceiling-mounted, fire-prevention sprinkler systems. The device includes a shroud member that removably encloses a selected sprinkler head and a positioning means that selectively maintains the shroud member in a preferred orientation with reselect to the sprinkler head. An included tearing member facilitates removal of the shroud member. The tearing member is a flexible, inelastic member that, when pulled correctly, will tear the shroud member along a predetermined path, even if the shroud has been coated with finishing material. The shroud member, itself, is characterized by lines of perforation that cooperate with the tearing member to ease shroud member removal.

Thus, it is an objective of the instant invention to provide a sprinkler head protection device that protects a selected pendent-type sprinkler head from damage while the surrounding ceiling is being treated.

An additional objective of the instant invention is to provide a sprinkler head protection device that is easily installed and removed, without the need for tools and without damaging the protected sprinkler head, even if the device has been coated with finishing material.

A further objective of the instant invention is to provide a sprinkler head protection device that is inexpensive and disposable if desired.

Yet another objective of the instant invention is to provide a sprinkler head protection device that includes provisions to facilitate easy removal so as to prevent rough handling during the removal process, thereby protecting the underlying sprinkler head.

A still further objective of the instant invention is to provide a sprinkler head protection device that does not interfere with sprinkler head functionality after removal.

An additional objective of the instant invention is to provide a sprinkler head protection device that is usable in warm climates and in buildings without air conditioning.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
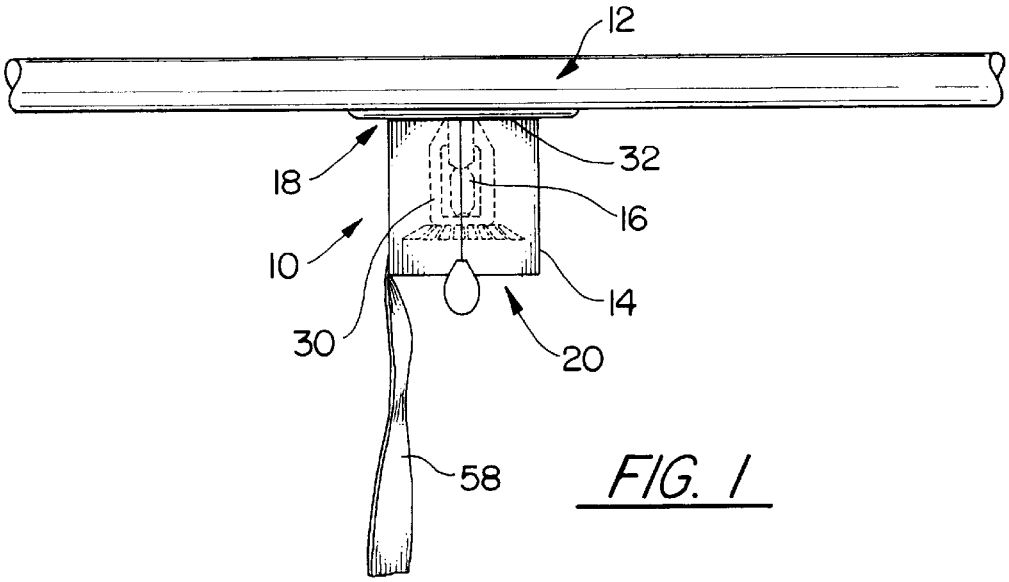
FIG. 1 is a pictorial view of the sprinkler head protection device of the present invention, shown in use on a ceiling-mounted fire-prevention system sprinkler head.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with respect to FIG. 1, the fire-prevention sprinkler protection device 10 of the present invention is shown in use with a ceiling-mounted fire-prevention sprinkler system 12. By way of overview, the protection device 10 includes a shroud member 14 sized and shaped to removably enclose a pendant-type fire-prevention sprinkler head 16 and a positioning means 18 for selectively maintaining the shroud member in a preferred orientation with respect to the sprinkler head. The protection device 10 also includes a tearing member 20 that facilitates removal of the shroud member 14. The shroud member 14, itself, is characterized by lines of perforation 22 that cooperate with the tearing member 20 to ease shroud member removal. The details of the protection device 10 will now be discussed.

Figure 2:
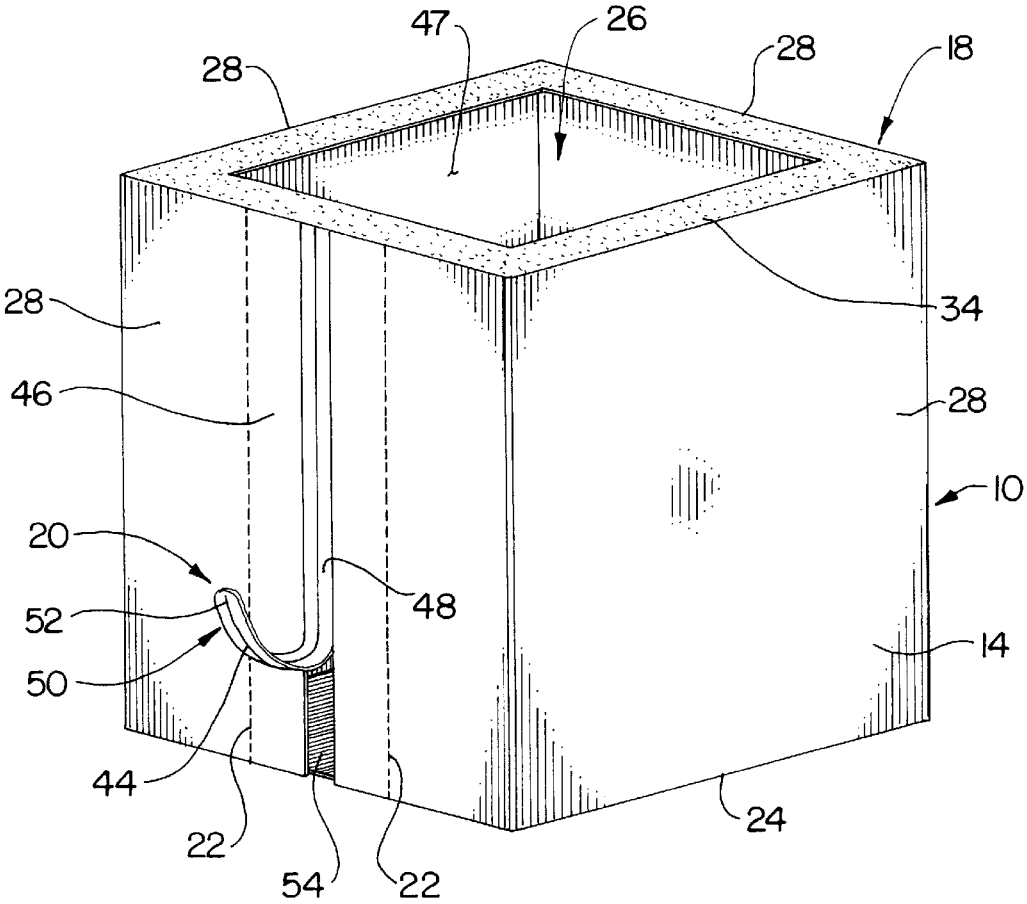
FIG. 2 is a close-up view of the shroud member shown in FIG. 1.

With additional reference to FIG. 2, the shroud member 14 is essentially a bag-like sleeve adapted to enclose a pendant-type sprinkler head 16. In a preferred embodiment, the shroud member 14 is a paper big having a first end panel 24 spaced apart from a second end insertion aperture 26 by four walls 28 extending therebetween. Although the protection device 10 of the present invention is described as being used with pendant-type sprinkler heads 16, it is noted that the present invention need not be used only with pendant-type sprinkler heads. The present invention 10 may, for example, be used to protect other types of sprinkler heads, including upright sprinkler heads 16', shown in FIG. 5. As a result, the present invention 10 may advantageously be used in a variety of settings, including ceilings that incorporate decorative panels and ceilings that do not.

During use, the shroud remember 14 is placed over the sprinkler head 16 by inserting the free end 20 of the sprinkler head 16 into the shroud insertion aperture 26. The shroud member 14 is then slid along the sprinkler head 16. In this manner, the shroud member 14 insertion aperture 26 approaches the attached end 32 of the sprinkler head 16 and the shroud member first end panel 24 moves toward the sprinkler head free end 30. Once positioned to enclose the sprinkler head 16, the shroud member 14 is held in place by the positioning means 18 described below.

In a preferred embodiment, as shown in FIG. 2, the positioning means 18 includes pressure-sensitive adhesive 34 disposed adjacent the insertion aperture 26. With this arrangement, once the shroud member 14 is positioned around a selected sprinkler head 16, the shroud member is fixed in place by constricting the insertion aperture 26 against the sprinkler head 16. As the insertion aperture 26 is forced against the sprinkler head 16, the adhesive 34 becomes releasably affixed to thereto. In this manner, the protection device 10 of the present invention will stay in place until intentionally removed.

Figure 3A:
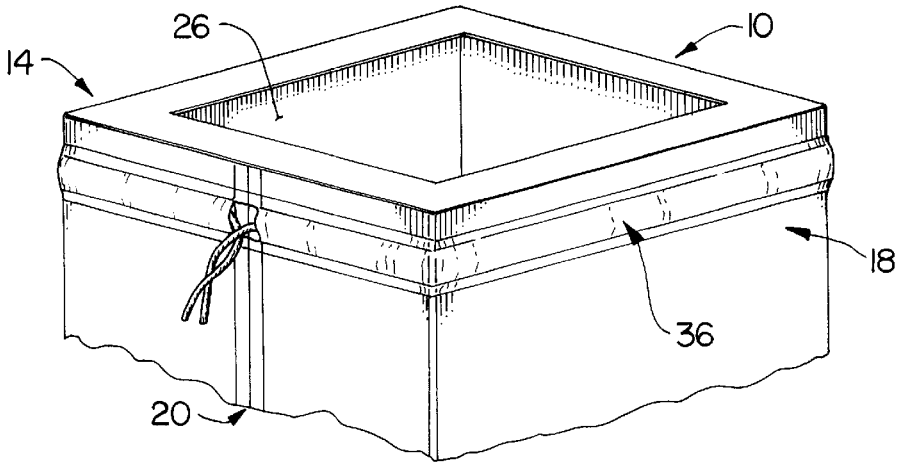
FIG. 3A is a close up view of an alternate embodiment of the positioning means shown in FIG. 1.
Figure 3B:
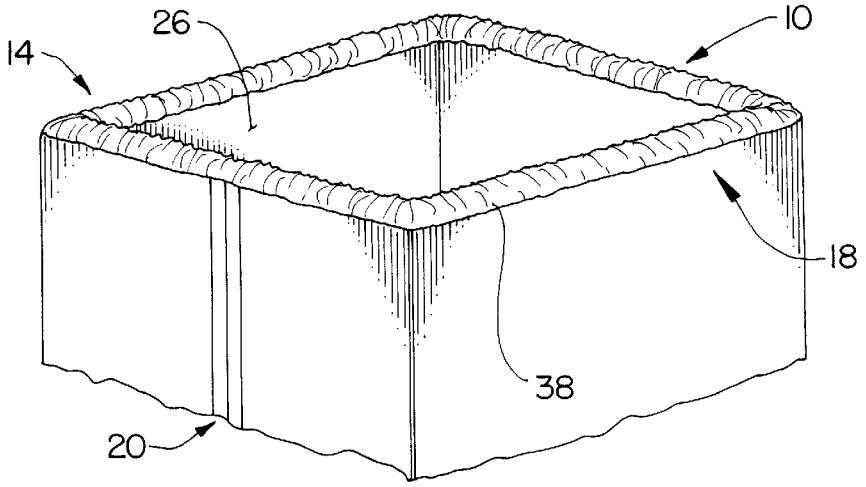
FIG. 3B is a close up view of an alternate embodiment of the positioning means shown in FIG. 1.
Figure 3C:
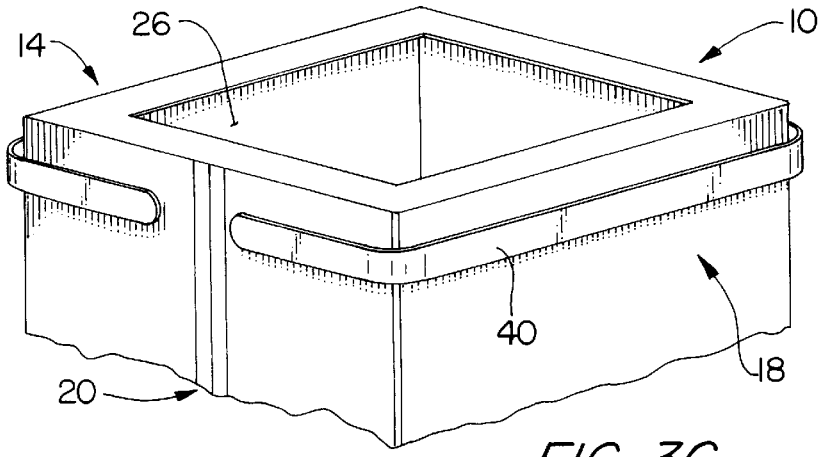
FIG. 3C is a close up view of an alternate embodiment of the positioning means shown in FIG. 1.
Figure 3D:
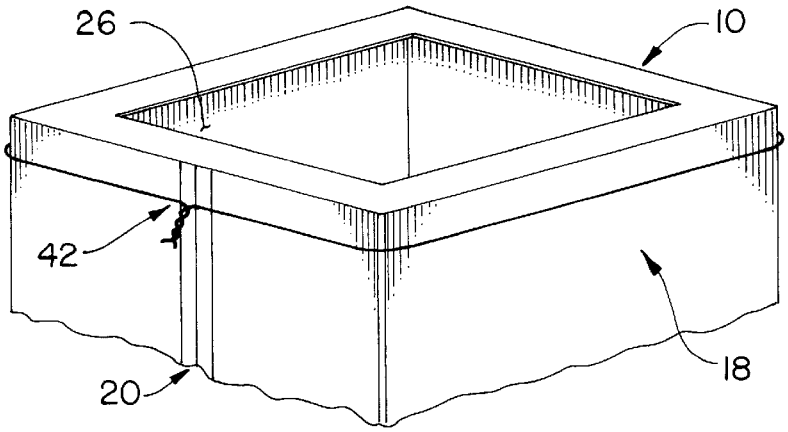
FIG. 3D is a close up view of an alternate embodiment of the positioning means shown in FIG. 1.

The positioning means 18 reed not be an adhesive region; other arrangements may also suffice. For example, as shown in FIG. 3A, the positioning means 18 could include a drawstring arrangement 36 that is adjustably tightened once the shroud member 14 is in place. Alternatively, as shown in FIG. 3B, the insertion aperture 26 can be fitted with elastic 38. The shroud member 14 may also be held in place, as shown in FIG. 3C, with a resiliently-deformable band or clip 40 sized and shaped to selectively engage he sprinkler head 16. The positioning means 18 could also, as shown in FIG. 3D, include a flexible member 42, such as a paper-coated wire, adapted to encircle the sprinkler head 16, thereby holding the shroud member 14 in place.

In keeping with the objectives of the present invention, the device 10 includes a tearing member 20 that facilitates removal of the device, even if the device has been coated with finishing material. In a preferred embodiment, as seen in FIG. 1, the tearing member 20 includes a flexible, inelastic cord 44 disposed along the. shroud member 14. More particularly, the tearing member 20 extends along the exterior surface 46 of the shroud member 14 and is secured thereagainst via an adhesive attachment tape 48 that extends substantially the entire length of the cord 44. A free end 50 of the tearing member 20 is characterized by a grasping flap 52.

When the protection device 10 is to be removed, an individual holds the grasping flap 52 and pulls the inelastic cord 44 back upon itself, thereby creating an elongated split 54 within the shroud member 14. Once the shroud member 14 is has been split, the fire-prevention sprinkler protection device 10 of the present invention tiny be easily removed without damaging the underlying sprinkler head 16.

The tearing member 20 need not be as described above; other arrangements may also suffice. For example, the tearing member 20 may include a metal cable, a polyolefin tape, or a nylon strip. Other inelastic members may be used as desired. Additionally, the tearing member 20 may be disposed along an interior surface 47 of the shroud member 14, with the grasping flap extending through the shroud member 14.

Figure 4:
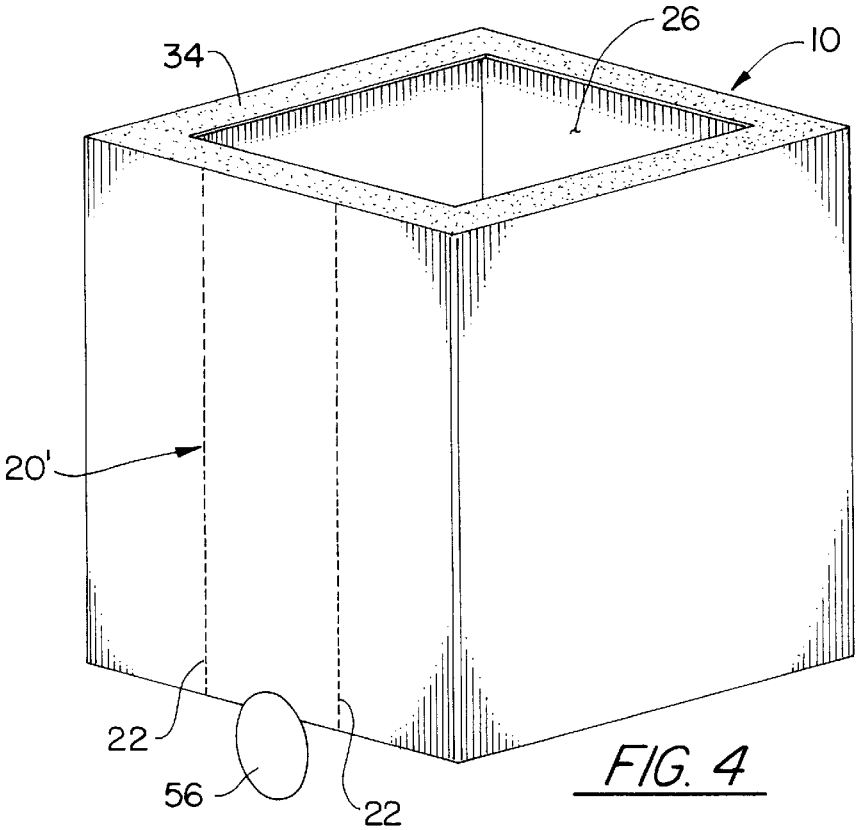
FIG. 4 is a pictorial view of an alternate embodiment of the tearing member of the present invention.

With reference to FIG. 4, an alternate embodiment of the tearing member 20' includes a pull tab 56 adhesively attached to the shroud member 14 exterior surface 46. In this embodiment, the pull tab 56 cooperates with the included lines of perforation 22 to ensure that the shroud member 14 may be torn in a controlled manner, facilitating removal of the protection device 10 without damaging the underlying sprinkler head 16. The lines of perforation 22 provide predetermined tear paths and will advantageously cooperate with each tearing member 20,20' embodiment. The lines of perforation may be omitted if desired.

Figure 5:
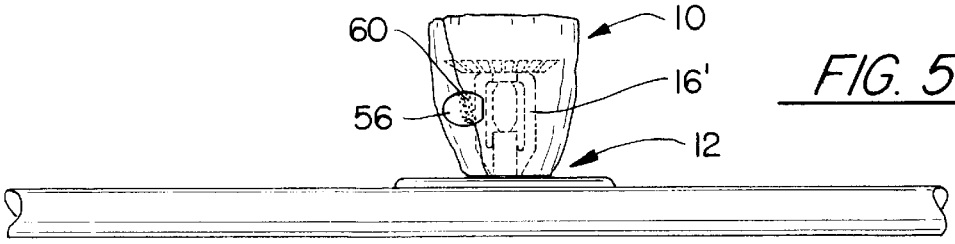
FIG. 5 is a pictorial view of the protection device of the present invention, shown in use on an upright sprinkler head, with a pull tab having a tab-securing adhesive region.

As seen in FIG. 5, the Full tab 56 may also be used to secure the shroud member 14 in place. The pull tab 56 may include a supplemental, tab-securing adhesive region 60 adapted to engage the shroud member exterior surface 46. With this arrangement, the second end 26 of the shroud member may be wrapped fittingly around the sprinkler head 16 and secured in place by pressing the adhesive region 60 of the pull tab 56 against the shroud member exterior surface 46.

As shown in FIG. 1, the protection device 10 of the present invention may also include a locator tag 58 that extends from the shroud member 4. The locator tag 58 need not be used in all cases, and may be omitted without negative result. In a preferred embodiment, the locator tag 58 resembles an elongated, flexible streamer. The locator tag 58 increases the visibility of device 10, ensuring that the device will remain conspicuous even if the shroud member 14 becomes coated with ceiling finishing materials.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A temporary fire-prevention sprinkler head protection device comprising:

a shroud member adapted to removably enclose a fire-prevention sprinkler head;

positioning means for selectively maintaining said shroud member in a preferred orientation with regard to said sprinkler head; and a tearing member disposed along a length of said shroud member, said tearing member adapted to produce an elongated split within said shroud member.

2. The fire-prevention sprinkler head protection device of claim 1, wherein:

said shroud member is made from paper.

3. The fire-prevention sprinkler head protection device of claim 1, wherein:

said positioning means is a drawstring associated with a first end of said shroud member.

4. The fire-prevention sprinkler head protection device of claim 1, wherein:

said positioning means is a resiliently deformable member associated with a first end of said shroud member, said resiliently deformable member being adapted to follow exterior contours of said sprinkler in a manner effective to removably secure said shroud member to said sprinkler head.

5. The fire-prevention sprinkler head protection device of claim 1, wherein:

said positioning means is adhesive disposed along a first end of said shroud member.

6. The fire-prevention sprinkler head protection device of claim 1, wherein:

said positioning means includes elasticized material disposed along said insertion aperture.

7. The fire-prevention sprinkler head protection device of claim 1, further including:

a grasping tab extending from a free end of said tearing member.

8. The fire-prevention sprinkler head protection device of claim 1, further including:

a plurality of perforations constructed and arranged to form at least one predetermined tear path within said shroud member.

9. The fire-prevention sprinkler head protection device of claim 1, further including:

a locator tag extending from said shroud member.

10. A temporary fire-prevention sprinkler head protection device comprising:

a shroud member adapted to removably enclose a fire-prevention sprinkler head;

positioning means for selectively maintaining said shroud member in a preferred orientation with regard to said sprinkler head; and a pull tab attached to said shroud member, said pull tab adapted to facilitate tearing of said shroud member.

11. The fire-prevention sprinkler head protection device of claim 10, wherein:

said shroud member is made from paper.

12. The fire-prevention sprinkler head protection device of claim 10, wherein:

said positioning means is a drawstring associated with a first end of said shroud member.

13. The fire-prevention sprinkler head protection device of claim 10, wherein:

said positioning means is a resiliently deformable member associated with a first end of said shroud member, said resiliently deformable member being adapted to follow exterior contours of said sprinkler in a manner effective to removably secure said shroud member to said sprinkler head.

14. The fire-prevention sprinkler head protection device of claim 10, wherein:

said positioning means is adhesive disposed along a first end of said shroud member.

15. The fire-prevention sprinkler head protection device of claim 10, wherein:

said positioning means is adhesive disposed along said pull tab, said adhesive adapted to selectively engage said shroud member.

16. The fire-prevention sprinkler head protection device of claim 10, further including:

a locator tag extending from said shroud member.

17. A fire-prevention sprinkler head protection device comprising:

a shroud member adapted to removably enclose a fire-prevention sprinkler head;

positioning means for selectively maintaining said shroud member in a preferred orientation with regard to said sprinkler head;

a tearing member disposed along a length of said shroud member, said tearing member adapted to produce an elongated split within said shroud member; and a plurality of perforations constructed and arranged to form at least one predetermined tear path within said shroud member.

18. The fire-prevention sprinkler head protection device of claim 17, wherein:

said positioning means is a drawstring associated with a first end of said shroud member.

19. The fire-prevention sprinkler head protection device of claim 17, wherein:

said positioning means is a resiliently deformable member associated with a first end of said shroud member, said resiliently deformable member being adapted to follow exterior contours of said sprinkler in a manner effective to removably secure said shroud member to slid sprinkler head.

20. The fire-prevention sprinkler head protection device of claim 17, wherein:

said positioning means is adhesive disposed along a first end of said shroud member.

21. The fire-prevention sprinkler head protection device of claim 17, further including:

a locator tag extending from said shroud member.

* * * * *